US009523245B2

(12) United States Patent
Hemph et al.

(10) Patent No.: US 9,523,245 B2
(45) Date of Patent: Dec. 20, 2016

(54) SHANK ADAPTOR WITH FRACTURE RESISTANT FLUSHING HOLE

(71) Applicant: SANDVIK INTELLECTUAL PROPERTY AB, Sandviken (SE)

(72) Inventors: Rasmus Hemph, Gavle (SE); Tomas Sh Jansson, Gavle (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/023,767

(22) PCT Filed: Sep. 1, 2014

(86) PCT No.: PCT/EP2014/068505

§ 371 (c)(1),
(2) Date: Mar. 22, 2016

(87) PCT Pub. No.: WO2015/039861

PCT Pub. Date: Mar. 26, 2015

(65) Prior Publication Data

US 2016/0215569 A1 Jul. 28, 2016

(30) Foreign Application Priority Data

Sep. 23, 2013 (EP) ..... 13185521

(51) Int. Cl.

| | |
|---|---|
| ***E21B 17/04*** | (2006.01) |
| ***E21B 1/02*** | (2006.01) |
| ***E21B 17/03*** | (2006.01) |
| ***E21B 17/042*** | (2006.01) |
| ***E21B 21/00*** | (2006.01) |
| ***E21B 1/00*** | (2006.01) |

(52) U.S. Cl.

CPC ..... *E21B 17/04* (2013.01); *E21B 1/00* (2013.01); *E21B 1/02* (2013.01); *E21B 17/03* (2013.01); *E21B 17/0426* (2013.01); *E21B 21/00* (2013.01)

(58) Field of Classification Search

CPC ..... E21B 17/03; E21B 1/02

See application file for complete search history.

(56) References Cited

U.S. PATENT DOCUMENTS

| | | | | |
|---|---|---|---|---|
| 5,399,027 A * | 3/1995 | Ijuin | F16C 33/6677 384/448 |
| 6,109,620 A * | 8/2000 | Roberts | B25D 17/005 228/114.5 |
| 2005/0208224 A1 * | 9/2005 | Stenberg | C23C 22/12 427/402 |

FOREIGN PATENT DOCUMENTS

| | | |
|---|---|---|
| CA | 2247842 A1 | 8/1997 |
| GB | 2212747 A | 8/1989 |
| GB | 2352671 A | 2/2001 |
| WO | 2004079152 A1 | 9/2004 |
| WO | 2008/133584 A1 | 11/2008 |
| WO | 2012032485 A2 | 3/2012 |

* cited by examiner

*Primary Examiner* — David Andrews
(74) *Attorney, Agent, or Firm* — Corinne R. Gorski

(57) ABSTRACT

A rock drilling shank adaptor includes an elongate body having an internal flushing bore and an entry hole through the sidewall of the adaptor in fluid communication with the internal bore. The flushing hole is optimized to reduce the likelihood of fracture at the wall of the adaptor and in particular includes straight sections at axially forward and rearwardmost regions of the hole.

11 Claims, 3 Drawing Sheets

SHANK ADAPTOR WITH FRACTURE RESISTANT FLUSHING HOLE

RELATED APPLICATION DATA

This application is a §371 National Stage Application of PCT International Application No. PCT/EP2014/068505 filed Sep. 1, 2014 claiming priority of EP Application No. 13185521.5, filed Sep. 23, 2013.

FIELD OF INVENTION

A rock drilling shank adaptor to form part of rock drilling apparatus and in particular, although not exclusively, to a shank adaptor having a flushing hole with an edge shape profile configured to minimise stress and stress concentrations at the region of the hole in response to compressive and/or tensile force.

BACKGROUND ART

Percussion drilling is a well-established technique that breaks rock by hammering impacts transferred from the rock drill bit, mounted at one end of a drill string, to the rock at the bottom of the borehole. The energy needed to break the rock is generated by a hydraulically driven piston that contacts a shank adaptor positioned at the opposite end of the drill string to the drill tool. The piston strike on the adaptor creates a stress (or shock) wave that propagates through the drill string and ultimately to the borehole rock bottom.

Shank adaptors typically comprise an internal bore to allow transfer of a flushing fluid to the region of the drill tool. The flushing fluid acts to both cool the tool and to expel drill cuttings and fines from the bore hole. Conventionally, the fluid is introduced into the shank adaptor via a radially extending hole in the adaptor wall that is submerged within a fluid tank that seals onto the external surface of the adaptor axially either side of the hole. Example shank adaptors with internal flushing bores are described in CA 2,247,842; GB 2352671; WO 2012/032485, WO 2008/133584 and WO 2004/079152.

A common problem with existing shank adaptors is the susceptibility for the adaptor wall to fracture with a crack originating and propagating from the flush hole due, in part, to the compressive and tensile stresses generated by the percussive piston and in particular the shock wave that is transmitted through the adaptor to the drill string and ultimately the drill tool. In underground applications, crack initiation is assisted by cavitational damage that exacerbates the problem. Shank adaptor failure is a particular problem for users as it often destroys the rubber seals at the fluid housing surrounding the adaptor. Time consuming replacement in repair of components is required resulting in very undesirable machine downtime. WO 2004/079152 discloses a flushing hole that attempts to reduce the stress at the region of the hole to mitigate fracture. However, there still exists a need for a shank adaptor having a flushing hole that further reduces or eliminates the likelihood of fracture in response to both compressive and tensile forces imparted and transmitted through the adaptor.

SUMMARY OF THE INVENTION

It is an objective of the present invention to provide a rock drilling shank adaptor having an entry hole for the introduction of a flushing fluid into the adaptor configured to minimise or eliminate the likelihood of fracture of the adaptor wall via a crack propagating from the flushing hole. It is a further objective to provide a shank adaptor configured to withstand the tensile and compressive forces experienced at the region of the flushing hole.

The objectives are achieved by a particular shape configuration of the flushing hole and in particular the shape configuration of forwardmost and rearwardmost regions of the hole with respect to the axial length of the adaptor. Specifically, the present flushing hole comprises non-curved, straight sections at these axially forward and rearwardmost parts of the hole to significantly reduce the tensile stresses at these regions without increasing stresses at other hole regions. The present configuration therefore is advantageous to significantly increase the service life of the adaptor particularly in environments where this mode of failure is problematic. According to a specific implementation, the present flushing hole comprises a super ellipse shape profile in which the axially forward and rearwardmost regions of the hole or slot do not comprise an arc that would otherwise present a region from where a crack could initiate. Curved, rounded or arced axial end regions of existing adaptor holes are replaced with the present straight sections according to the present invention. Importantly, the ends of the straight sections continue into curved sections in which each curve is formed from multiple radii of curvature so as to provide a smooth and gradual transition from the forward and rearward sections to respective side sections of the hole.

According to a first aspect of the present invention there is provided a rock drilling shank adaptor comprising: an elongate body having a first end to be positioned towards a piston and a second end to be positioned towards a drill string; a body comprising an axially extending internal bore to allow passage of a flushing fluid to the drill string via the second end; a flush hole extending radially through the body to the internal bore, the hole defined at an external side by an edge having an axially forward region positioned closer to the second end than an axially rearward region positioned closer to the first end; characterised in that: the forwardmost and rearwardmost regions of the edge comprise straight sections, each straight section bordered at each end by a respective curved section.

The adaptor further comprises what may typically be regarded as side sections extending axially between ends of the respective curved sections to complete the edge to form a closed loop. Preferably, the side sections are straight. More preferably, the side sections are aligned parallel to a longitudinal axis of the adaptor. Such a configuration is advantageous to facilitate manufacturing as the flushing hole that may be formed using a conventional drill tool advanced axially to create an elongate slot.

Preferably, the straight sections are aligned perpendicular to a longitudinal axis of the adaptor. This is beneficial to minimise stress concentrations at the region of the hole due to non-symmetrical changes in the stresses around the hole relative to a longitudinal axis of the adaptor. That is, the present invention is configured to reduce as far as possible the risk of fracture of the adaptor wall due to differences in the stress type (compressive and tensile) around the hole as a shock wave is transmitted through the adaptor.

Preferably, the curved sections comprise a curvature profile formed from a plurality of radii such that a radius of the curve decreases in a direction away from each straight section perpendicular to a longitudinal axis of the adaptor. This is advantageous to provide a smooth gradual transition from the straight sections to the side sections so as to minimise stress concentrations due to both compressive and tensile loading with a particular emphasis on fatigue reduction in response to compressive forces.

The present hole edge shape profile curves gradually away from the axial endmost straight sections to eliminate zones within the adaptor wall that could represent zone for high stress concentration due to non-smooth or angled edge sections.

Preferably, a shape profile of the edge is elongate such that an axial length of the hole is greater than a width of the hole in a plane perpendicular to a longitudinal axis of the adaptor. Preferably, a shape profile of the hole at the edge is substantially rectangular in which corners of the rectangle are curved according to a multiple radii of curvature. Utilising a series of different radii of curvature for each arched region of the hole edge eliminates sudden changes in the direction of the edge relative to the longitudinal axis.

Preferably, a length of each forward and rearward straight section in a plane perpendicular to a longitudinal axis of the adaptor is substantially equal. Preferably, a shape profile of the edge is symmetrical in both an axial plane and a plane perpendicular to a longitudinal axis of the adaptor. A symmetrical shape profile is advantageous for both ease of manufacture and to provide a uniform distribution of stress around the region of the hole and throughout the adaptor generally.

Preferably, a shape profile of the edge is maintained in the radial direction through the elongate body from the external side to the internal bore. That is, the shape profile of the hole is uniform through the radial direction of the adaptor wall between the external surface and the internal bore. Specifically, the internal edge shape profile of the flush hole corresponds and is substantially identical to the edge shape profile at the external side of the adaptor. The stress characteristic at the region of the hole is therefore intended to be uniform in a radial direction through the adaptor wall and in particular both the external and internal surfaces of the elongate body around the region of the hole.

Optionally, a shape profile of the edge is defined by the equation $(x/a)^n+(y/b)^n=1$, where x is aligned with the longitudinal axis of the adaptor. Preferably a is substantially equal to b and where n is a real number, including decimals where optionally $3<n<5$. Optionally, $a=r$; $b=r+dr$ where $-r<dr<r$ and preferably $dr=0$ where r may be in the range 0 to W/2 where W is a width of the hole in a direction perpendicular to the longitudinal axis of the adaptor. Optionally, According to specific implementations r is between 0 and 15 and optionally 2 to 13.

According to a second aspect of the present invention there is provided rock drilling apparatus comprising a shank adaptor as claimed herein. Preferably, the apparatus further comprises an elongate piston having a main length and an energy transmission end to contact the first end of the adaptor; and a drill string formed from a plurality of coupled elongate drill rods, wherein a rearwardmost drill rod of the string is coupled to the second end of the adaptor.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
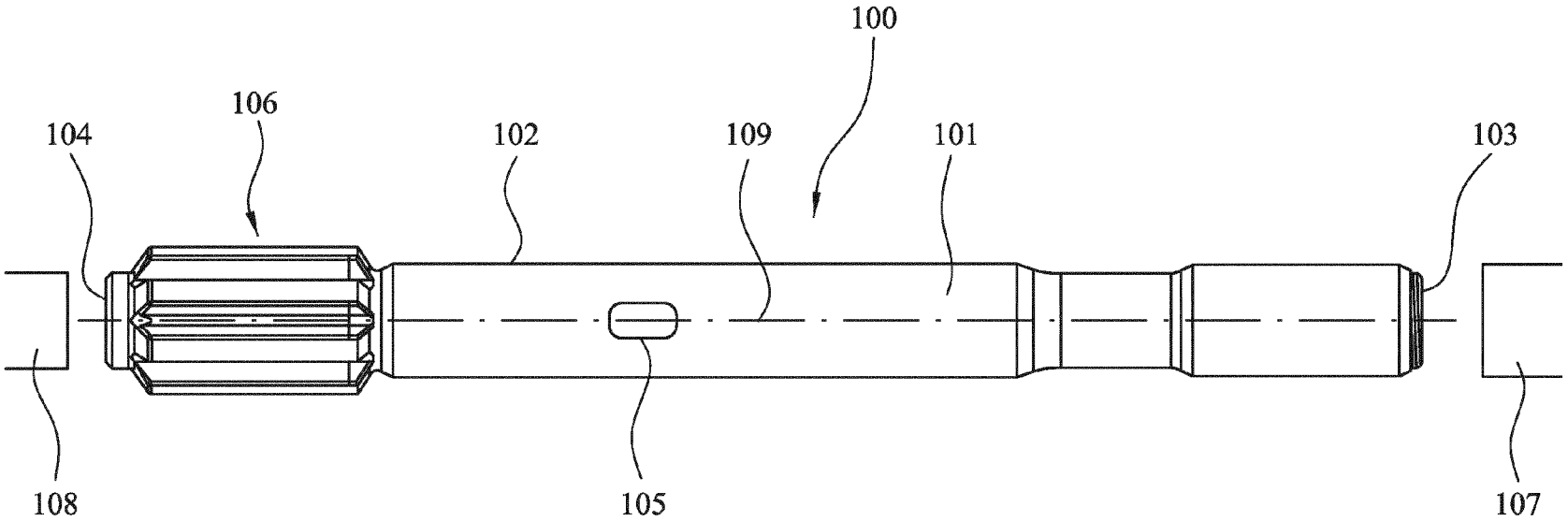
FIG. 1 illustrates an external view of a shank adaptor forming part of rock drilling apparatus comprising an elongate drill string and a hydraulically driven reciprocating piston according to a specific implementation of the present invention.

Referring to FIG. 1, rock drilling apparatus comprises an elongate energy transmission adaptor 100 comprising a main body (or length section) 101 having a forward end 103 and a rearward end 104 relative to a longitudinal axis 109. A plurality of axially parallel elongate splines 106 project radially outward from an external surface 102 at a rearward region of elongate main body 101 towards rearward end 104. Splines 106 are configured to be engaged by corresponding splines of a rotational motor (not shown) to induce rotation of adaptor 100 about axis 109 during drilling operations. Adaptor 100 further comprises a flush bore 105 positioned axially between ends 103, 104 and extending radially through the adaptor main body 101 from external surface 102 to an internal cavity or region extending axially within adaptor 100.

Adaptor 100 is configured for coupling to an elongate drill string and to allow transmission of a stress wave to a drill tool (not shown) located at the deepest region of the drill hole to impart the percussion drilling action. In particular, adaptor forward end 103 may be coupled to a rearward end of a rearwardmost elongate drill rod 107 forming a part of the drill string. The rearwardmost adaptor end 104 is configured to be contacted by a hydraulically driven piston 108 that creates the stress wave within adaptor 100 and the drill string. Such apparatus further comprises a flushing fluid tank and associated seals, valves and pumps (not shown) positioned external around adaptor surface 102 such that flush hole 105 is submerged within the tank to allow introduction of the fluid into adaptor 100 and subsequently axially through the elongate drill rods 107.

Figure 2:
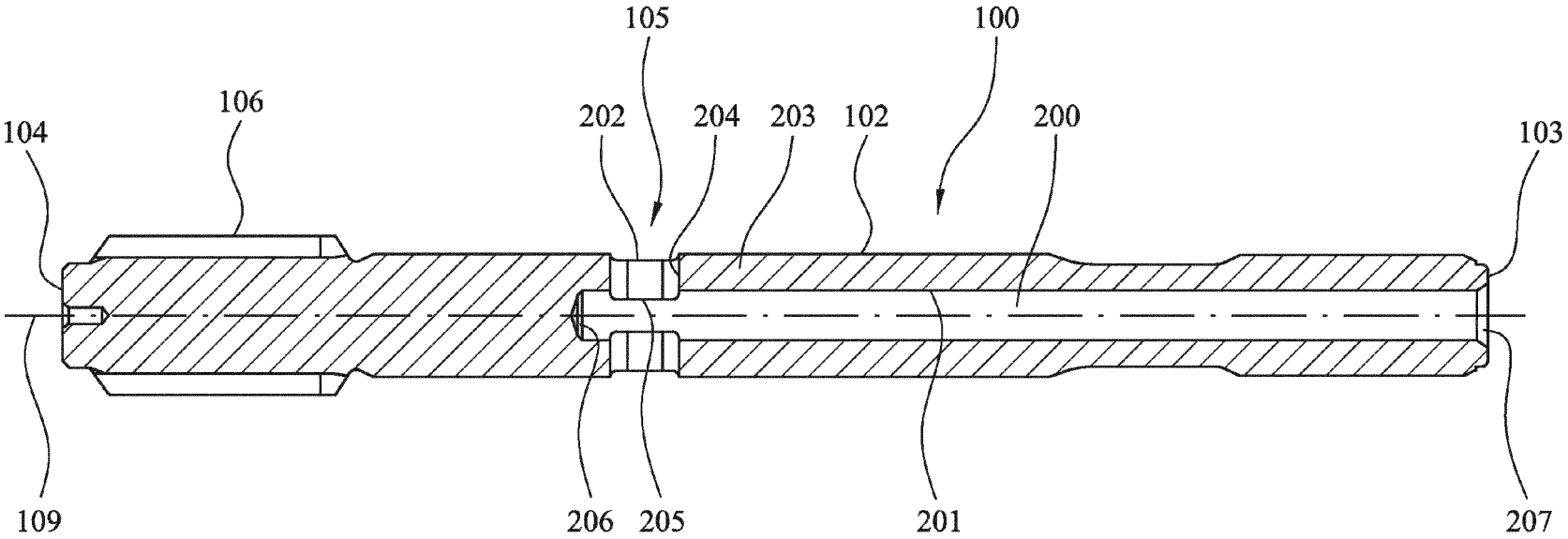
FIG. 2 illustrates a cross sectional side view through the adaptor of FIG. 1.
Figure 3:
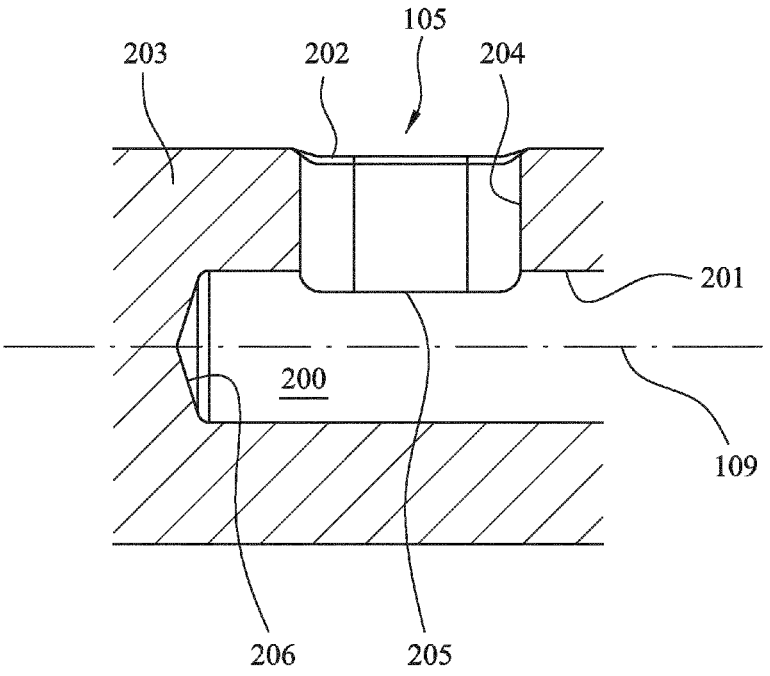
FIG. 3 illustrates a magnified cross sectional view of the flush bore within the adaptor of FIG. 2.

Referring to FIGS. 2 and 3, adaptor 100 comprises an internal elongate bore 200 extending axially from the region of hole 105 to forwardmost end 103. In particular, bore 200 comprises a rearwardmost end 206 and an open forwardmost end 207 positioned in fluid communication with the internal bore (not shown) extending through each drill rod 107.

Hole 105 is defined by an external edge 202 having a closed loop configuration in which the loop comprises straight regions and curved regions. Hole 105 extends radially through adaptor wall 203 from external surface 102 to internal surface 201 that defines internal bore 200. Accordingly, flush hole 105 is further defined by an innermost or internal edge 205 having an identical shape profile to the external edge 202, with edges 202, 205 coupled by a radially extending surface 204, aligned perpendicular to axis 109, that defines the radial wall of bore hole 105. Surface 204 is substantially straight and non-curved in a plane perpendicular to axis 109 such that a shape profile of hole 105 is uniform in a radial direction from external edge 202 to internal edge 205. In use, fluid is introduced into adaptor 100 via hole 105. The fluid is then forced through bore 200 and into the rearwardmost drill rod 107 to provide the flushing of cuttings from the region around the drill tool (not shown) and cooling of both the drill rods 107 and cutting tool (as the adaptor 100 and rods 107 are rotated about axis 109 during cutting operations).

Figure 4:
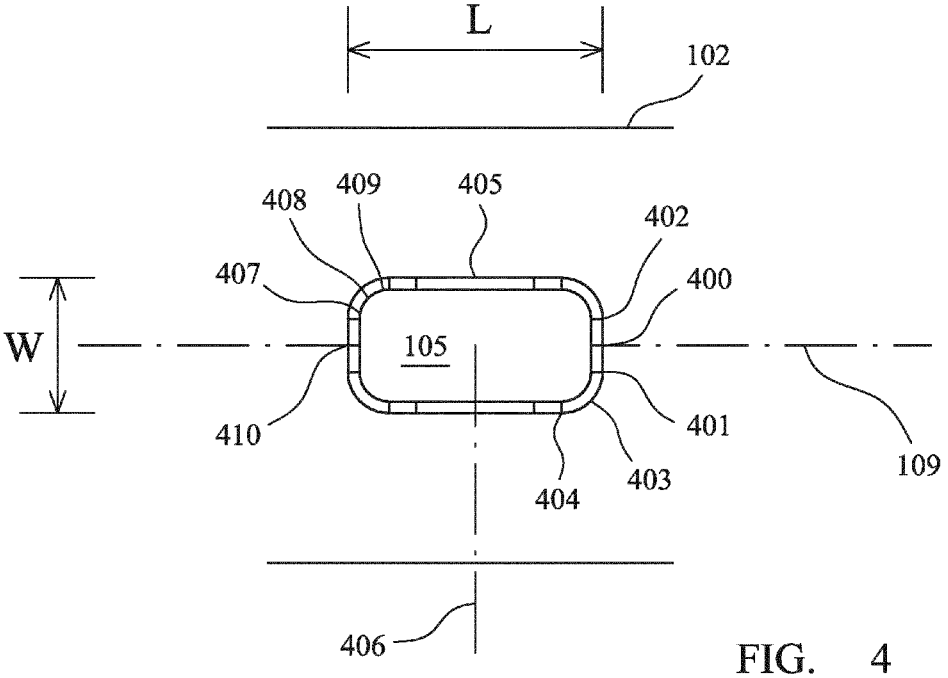
FIG. 4 illustrates a magnified external view of the flush hole formed in the adaptor of FIG. 1 according to a specific implementation of the present invention.

Referring to FIG. 4, flush hole 105 comprises a generally elongate shape profile in which an axial length L is greater than a width W in a plane 406 perpendicular to axis 109. Hole 105 may be regarded as comprising an axially forward region 400 positioned closer to adaptor forward end 103 relative to an axially rearward region 410 positioned closer to adaptor rearward end 104. Forward and rearward regions 400, 410 are formed by a respective non-curved straight section such that the radially extending wall surface 204 at the forward and rearward regions 400, 410 is substantially planar in a plane corresponding to plane 406 being perpendicular to axis 109. The respective straight edge regions 400, 410 are bordered at each respective end 401, 402 by curved sections 403 each curved section 403 is curved through substantially 90° both outwardly and rearwardly from forward region 400 and outwardly and forwardly from rearward region 410. That is, each curved section 403 is defined between straight section end 401, 402 and an axial end 404 of a side section 405. The side sections 405 are non-curved and are aligned parallel with axis 109 and perpendicular to forward and rearward straight regions 400, 410. An axial length of side sections 405 is greater than the corresponding length of straight regions 400, 410 (between ends 401, 402) such that hole 105 comprises a generally elongate configuration aligned axially with the main length of adaptor 100. Accordingly, the wall surface 204 in a radial direction from external edge 202 to internal edge 205 at each side section 405 is substantially planar.

Each curved edge section 403 comprises a shape profile defined by a plurality of different radii of curvature to form a sweeping arc transition between the forward (and rearward) ends 401, 402 and side section ends 404. In particular, a radius of curvature at end regions 407, 409 of curved section 403 are greater than the corresponding radius of curvature at a mid-curved region 408. Such a configuration is advantageous to minimise stress concentrations as the stress wave (either compressive or tensile) is transmitted axially through adaptor wall 203 past hole 105.

The subject invention is advantageous to minimise stress and stress concentrations at the forward and rearward regions 400, 410 in response to compressive loading along the axis 109 and, in particular, a resulting and magnified compressive force at curved sections 403 and a tensile stress at the mid-region of straight regions 400, 410. The present hole shape profile is configured to distribute the stresses and in particular reduce the stress loading at the forward and rearward regions 400, 410 due to changes in stress type (compressive and tensile) at the locations of the adaptor 100 adjacent both the curved sections 403 and straight regions 400, 410. According to one specific implementation, a shape profile of hole 105 at both the external and innermost edges 202, 205 takes the form of a super ellipse, optionally defined by equation $x^n+y^n=r^n$ where n is a real number, including decimals being $3<n<5$. The value r is in the range 0 to W/2 and in particular is between 2 to 13 mm.

Using computation simulations with a super ellipse shape profile at edges 202, 205 as defined by the above equation where r is 12 mm, an adaptor 100 having a typical length and width configuration was found to exhibit significantly reduced stress concentrations at the region of hole 105. In particular, subjecting the adaptor 100 at the region of slot 105 to a static compressive load of 250 MPa, a maximum stress observed was 325 MPa, in turn, providing a stress concentration factor of 325/250=1.3. This is to be contrasted with an adaptor having a flush hole (105), in which the forward and rearward regions (corresponding to a combination of straight regions 400, 410 and curved sections 403) are semi-circular (with intermediate straight sections 405). Such a configuration results in a maximum stress of 384 MPa and a stress concentration factor of 384/250=1.54. Accordingly, the present configuration provides a 15% stress reduction which is significant as adaptor 100 is subject to high cycle fatigue, due to the rapid reciprocating impact motion of piston 108. An adaptor comprising a flush hole 105 of the present invention therefore provides an enhancement in the operational lifetime of the device.

The invention claimed is:

1. A rock drilling shank adaptor comprising:

an elongate body having a first end to be positioned towards a piston and a second end to be positioned towards a drill string, the body including an axially extending internal bore to allow passage of a flushing fluid to the drill string via the second end; and a flush hole extending radially through the body to the internal bore, the hole defined at an external side by an edge having an axially forward region positioned closer to the second end than an axially rearward region positioned closer to the first end, wherein the forwardmost and rearwardmost regions of the edge include straight sections, each straight section being bordered at each end by a respective curved section, wherein each of the curved sections has a curvature profile formed from a plurality of radii, such that a radius of the curvature decreases in a direction away from each straight section perpendicular to a longitudinal axis of the adaptor.

2. The adaptor as claimed in claim 1, further comprising side sections extending axially between ends of the respective curved sections to complete the edge to form a closed loop.

3. The adaptor as claimed in claim 2, wherein each of the side sections are straight.

4. The adaptor as claimed in claim 3, wherein each of the side sections are aligned parallel to a longitudinal axis of the adaptor.

5. The adaptor as claimed in claim 1, wherein a shape profile of the edge is elongate such that an axial length of the hole is greater than a width of the hole in a plane perpendicular to a longitudinal axis of the adaptor.

6. The adaptor as claimed in claim 1, wherein a shape profile of the hole at the edge is substantially rectangular and in which corners of the rectangle are curved according to multiple radii of curvature.

7. The adaptor as claimed in claim 1, wherein a length of each forward and rearward regions is substantially equal in a plane perpendicular to a longitudinal axis of the adaptor.

8. The adaptor as claimed in claim 1, wherein a shape profile of the edge is symmetrical in both an axial plane and a plane perpendicular to a longitudinal axis of the adaptor.

9. The adaptor as claimed in claim 1, wherein a shape profile of the edge is maintained in the radial direction through the elongate body from the external side to the internal bore.

10. A rock drilling apparatus comprising a shank adaptor as claimed in claim 1.

11. The apparatus as claimed in claim 10, further comprising:

an elongate piston having a main length and an energy transmission end to contact the first end of the adaptor; and a drill string formed from a plurality of coupled elongate drill rods, wherein a rearwardmost drill rod of the string is coupled to the second end of the adaptor.

* * * * *